US010396426B2

(12) United States Patent
Michaelis et al.

(10) Patent No.: US 10,396,426 B2
(45) Date of Patent: Aug. 27, 2019

(54) ALIGNMENT DETERMINATION FOR ANTENNAS

(71) Applicant: CommScope Technologies LLC, Hickory, NC (US)

(72) Inventors: Scott L. Michaelis, Plano, TX (US); Trevor M. Allen, Sacshe, TX (US); George P. Vella-Coleiro, Summit, NJ (US)

(73) Assignee: CommScope Technologies LLC, Hickory, NC (US)

( * ) Notice: Subject to any disclaimer, the term of this patent is extended or adjusted under 35 U.S.C. 154(b) by 144 days.

(21) Appl. No.: 14/418,171

(22) PCT Filed: Aug. 15, 2014

(86) PCT No.: PCT/US2014/051173
§ 371 (c)(1),
(2) Date: Jan. 29, 2015

(87) PCT Pub. No.: WO2015/031072
PCT Pub. Date: Mar. 5, 2015

(65) Prior Publication Data

US 2016/0020504 A1 Jan. 21, 2016

Related U.S. Application Data

(60) Provisional application No. 61/870,298, filed on Aug. 27, 2013.

(51) Int. Cl.
*H01Q 1/12* (2006.01)
*H01Q 1/24* (2006.01)

(52) U.S. Cl.
CPC ..... *H01Q 1/125* (2013.01); *H01Q 1/246* (2013.01)

(58) Field of Classification Search
CPC ..... H01Q 1/125; H01Q 1/246; G01R 33/025; F41G 7/30; G01S 19/47; G01C 9/02;
(Continued)

(56) References Cited

U.S. PATENT DOCUMENTS 2,696,602 A * 12/1954 Evans ..... G01R 33/025 324/253
2,928,668 A * 3/1960 Blasingame ..... G01P 15/097 73/514.15
(Continued)

FOREIGN PATENT DOCUMENTS

CA 2353629 A1 * 6/2000 ..... G01C 19/56
CA 2353629 A1 * 6/2000 ..... G01C 19/56
(Continued)

OTHER PUBLICATIONS

Notification Concerning Transmittal of International Preliminary Report on Patentability for corresponding PCT Application No. PCT/US2014/051173, dated Mar. 10, 2016, 8 pages.
(Continued)

*Primary Examiner* — Vladimir Magloire
*Assistant Examiner* — Nuzhat Pervin
(74) *Attorney, Agent, or Firm* — Myers Bigel, P.A.

(57) ABSTRACT

An exemplary alignment module for a base station antenna has one or more accelerometers and one or more magnetometers. The one or more accelerometers are used to determine tilt and roll angles of the antenna, while the yaw angle of the antenna is determined using the one or more magnetometers and the determined tilt and roll angles. Using multiple accelerometers and/or multiple magnetometers can improve accuracy of angle determination. A service provider can determine when to re-align the antenna by monitoring the tilt, roll, and yaw angles remotely to detect changes in antenna orientation. Yaw angle determination can
(Continued)

also take into account offset values corresponding to soft-iron effects, hard-iron effects, and factory calibration. The need to re-calibrate offset values following changes in local magnetic environment can be detected by comparing different sensor signals, such as the different magnetic fields detected by a plurality of magnetometers.

19 Claims, 4 Drawing Sheets

(58) Field of Classification Search
CPC ..... G01C 17/38; G01C 21/20; G01C 17/30; G01C 21/165; G01C 25/00; G01C 15/06; G05D 1/0259; G01B 7/00; G01B 21/22; H04B 1/0064; F41H 11/02; E21B 47/022
USPC ..... 342/359
See application file for complete search history.

(56) References Cited

U.S. PATENT DOCUMENTS 2,959,057 A * 11/1960 Winker ..... G01P 15/121 73/514.06
3,239,754 A * 3/1966 Odom, Jr. ..... G01R 33/05 324/247
3,465,597 A * 9/1969 Weisbord ..... G01P 15/097 73/514.29
3,596,069 A * 7/1971 Burt ..... G01C 17/30 235/144 M
3,699,316 A * 10/1972 Lopes, Jr. ..... G01C 21/18 701/504
3,781,664 A * 12/1973 Rorden ..... G01R 33/022 324/247
4,204,210 A * 5/1980 Hose ..... F41G 7/30 342/25 A
4,875,014 A * 10/1989 Roberts ..... E21B 47/02224 324/326
5,105,894 A * 4/1992 Enderlin ..... E21B 25/16 166/255.2
5,383,363 A * 1/1995 Kulmaczewski ... G01P 15/0888 73/510
5,432,699 A * 7/1995 Hache ..... E21B 47/022 702/9
5,467,083 A * 11/1995 McDonald ..... E21B 47/122 340/854.4
5,790,075 A 8/1998 Inugai et al.
6,212,476 B1 * 4/2001 Noy ..... E21B 47/022 702/9
6,636,826 B1 * 10/2003 Abe ..... G01C 19/56 702/151
6,895,678 B2 * 5/2005 Ash ..... E21B 47/022 33/313
7,009,558 B1 * 3/2006 Fall ..... G01S 19/47 342/359
7,093,370 B2 * 8/2006 Hansberry ..... E21B 47/022 33/313
7,451,549 B1 * 11/2008 Sodhi ..... G01C 17/38 33/356
7,587,277 B1 * 9/2009 Wells ..... G01C 21/165 701/510
8,010,308 B1 * 8/2011 Churchill ..... G01C 25/005 702/104
8,060,146 B2 11/2011 Takamatsu et al.
8,275,544 B1 * 9/2012 Wells ..... G01C 21/165 342/146
8,340,905 B2 * 12/2012 Roberts ..... G05D 1/0259 701/470
8,471,780 B2 6/2013 Dalmazzo
8,473,211 B2 * 6/2013 Cheung ..... E21B 47/022 324/244
8,548,766 B2 * 10/2013 Judd ..... G01C 19/56 702/104
8,577,637 B2 * 11/2013 Vogt ..... G01C 17/38 702/92
8,766,872 B2 * 7/2014 Dalmazzo ..... G01B 21/22 343/894
8,766,873 B2 7/2014 Dalmazzo
8,768,647 B1 * 7/2014 Zaki ..... G01C 21/16 702/150
9,141,194 B1 * 9/2015 Keyes ..... G06F 3/017
9,476,734 B2 * 10/2016 Askarpour ..... G01C 25/00
9,541,392 B2 * 1/2017 Dusha ..... G01C 15/06
2001/0042405 A1 * 11/2001 Hulsing, II ..... F02G 1/044 73/514.02
2002/0188416 A1 * 12/2002 Zhou ..... G01C 17/28 702/151
2003/0005767 A1 * 1/2003 Hulsing, II ..... F02G 1/044 73/514.02
2006/0061545 A1 * 3/2006 Hughes ..... G06F 3/016 345/156
2006/0100820 A1 * 5/2006 Davidson ..... G01B 21/22 702/151
2007/0001920 A1 * 1/2007 Webb ..... H01Q 1/08 343/766
2007/0220973 A1 * 9/2007 Acar ..... G01C 19/5719 73/504.12
2008/0169413 A1 7/2008 Austin et al.
2009/0061941 A1 3/2009 Clark
2011/0063167 A1 * 3/2011 Gum ..... G01C 21/20 342/357.65
2011/0199274 A1 * 8/2011 Dalmazzo ..... G01B 21/22 343/760
2011/0307213 A1 * 12/2011 Zhao ..... G01C 17/30 702/153
2013/0185018 A1 * 7/2013 Sheng ..... G01B 7/00 702/153
2014/0155098 A1 * 6/2014 Markham ..... H04B 1/0064 455/456.3
2015/0016216 A1 * 1/2015 Sudow ..... G01P 21/00 367/13
2016/0048129 A1 * 2/2016 Kolanek ..... F41H 11/02 701/2
2018/0125416 A1 * 5/2018 Schwarz ..... A61B 5/486

FOREIGN PATENT DOCUMENTS

EP 1501153 A1 1/2005
GB 2478691 A * 9/2011 ..... G01C 17/00
WO WO2009097282 A1 8/2009

OTHER PUBLICATIONS

Extended European Search Report for corresponding European Application No. 16174378.6, dated Dec. 15, 2016, 7 pages.
Antenna Interface Standards Group, "Control interface for antenna line devices", Standard No. AISG v2.0, Jun. 13, 2006, pp. 1-41.
AISG Extension: Geographic Location Sensor "Geographic Location Sensor Extension to the Control Interface for Antenna Line Devices", Standard No. AISG v2.1.0, Jan. 31, 2013, pp. 1-18.
AISG Extension: Geographic Location Sensor "Geographic Location Sensor Extension to the Control Interface for Line Devices", Standard No. AISG v2.1.0, Extension to AISG version 2.0, Jan. 31, 2013, pp. 1-31.
International Search Report and Written Opinion; dated Oct. 27, 2014 for corresponding PCT Application No. PCT/US2014/051173.

* cited by examiner

ALIGNMENT DETERMINATION FOR ANTENNAS

CROSS-REFERENCE TO RELATED APPLICATIONS

This application claims the benefit of the filing date of U.S. provisional application No. 61/870,298, filed on Aug. 27, 2013, the teachings of which are incorporated herein by reference in their entirety.

BACKGROUND

Field of the Invention

The present invention relates to techniques for determining alignment and, more specifically but not exclusively, to such techniques for determining the alignment of antennas for base stations in cellular communications systems and the like.

Description of the Related Art

This section introduces aspects that may help facilitate a better understanding of the invention. Accordingly, the statements of this section are to be read in this light and are not to be understood as admissions about what is prior art or what is not prior art.

In order to provide the required radio signal throughout a defined area, each directional antenna in a cellular communications system is intended to face a specific direction (referred to as "azimuth") relative to true north, to be inclined at a specific downward angle with respect to the horizontal in the plane of the azimuth (referred to as "tilt" aka "pitch"), and to be vertically aligned with respect to the horizontal (referred to as "roll" aka "skew"). Undesired changes in azimuth, tilt, and roll will detrimentally affect the coverage of a directional antenna. In general, the more accurate the installation, the better the network performance that may be achieved within the area served by the antenna.

An antenna's azimuth, tilt, and/or roll can change over time, due to the presence of high winds, corrosion, poor initial installation, vibration, hurricanes, tornadoes, earthquakes, or other factors. It is common for wireless service providers to conduct periodic audits of their communication antennas to ensure that each antenna has not deviated significantly from its desired azimuth, tilt, and/or roll directions. Wireless service providers frequently hire third-party tower companies to perform audits and to make any necessary adjustments to maintain the desired alignment. Such audits, however, may be labor intensive and dangerous, frequently requiring certified tower climbers to physically inspect each antenna, and to take appropriate measurements to determine any deviance from the desired positioning. This task can become even more time consuming if many towers are affected as a result of a hurricane or storm, in which case, it could take between two to four months to determine which towers have been affected, as the antennas have to be checked one by one.

There exist known techniques for determining whether an antenna is properly aligned or is maintaining its proper alignment. Some of these techniques make use of magnetometers, accelerometers, gyroscopes, and/or GPS (global positioning system) receivers to determine the current alignment of an antenna and/or to detect changes in antenna alignment over time. U.S. Pat. No. 8,766,872, for example, describes techniques that detect changes in an antenna's alignment using gyroscopes and accelerometers. The described method acknowledges the inherent weakness in using magnetometers in that they are "subject to local distortions in the earth's magnetic field" and, as a result, only claims "to detect only the relative change from an antenna's previously satisfactory orientation," not its current alignment. In addition, the described method does not address the antenna's geolocation (i.e., latitude, longitude, and altitude).

In January 2013, the Antenna Interface Standards Group (AISG) released the two extension specifications Standard Nos. AISG-ES-ASD v2.1.0 and AISG-ES-GLS v2.1.0 defining the required functionality of alignment sensor devices and geographic location sensors, respectively, which requires devices to determine and report the current alignment and position of an antenna over the existing interface defined by Standard No. AISG v2.0, the teachings of all three of which are incorporated herein by reference in their entirety. By doing this, the industry has expressed a specific need for a means of continuously monitoring the current alignment and position of base station antennas that can be seamlessly integrated into the existing infrastructure. The AISG alignment extension specification allows the operators of antennas to set desired angles for things like azimuth pointing angle and mechanical tilts. It further allows the operators to set "thresholds" which will subsequently trigger alarms if the angles change from the desired angles such that the thresholds are exceeded.

It is also possible to change the "Electronic Tilt" of the antenna. In this case, the physical orientation of the housing of the antenna doesn't change, but the effective angle of the beam can be adjusted. There are several methods for doing this including adjusting the power levels and/or phase of the signal to radiating elements internal to the antenna. This can be done using circuitry internal to the antenna which typically includes a controller. Typically this is controlled remotely via the AISG interface. This concept is called Remote Electronic Tilt or RET.

BRIEF DESCRIPTION OF THE DRAWINGS

Other embodiments of the invention will become more fully apparent from the following detailed description, the appended claims, and the accompanying drawings in which like reference numerals identify similar or identical elements.

DETAILED DESCRIPTION

Alignment Module

Figure 1:
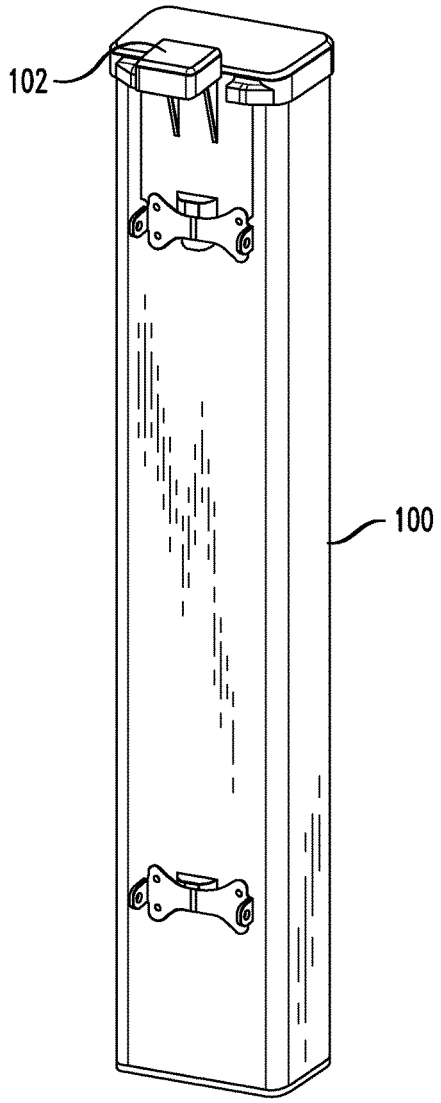
FIG. 1 shows a three-dimensional perspective view of a base station antenna configured with an exemplary alignment module designed for determining the alignment of the antenna.

FIG. 1 shows a three-dimensional perspective view of a base station antenna 100 configured with an exemplary alignment module 102 designed for determining the alignment of antenna 100. For this implementation, alignment module 102 may be rigidly mounted onto antenna 100 in the factory or in the field, e.g., after antenna 100 is mounted onto a base station tower. Alignment module 102 is aligned to have the same orientation (azimuth, tilt, and roll) of the antenna. Since alignment module 102 is rigidly mounted onto antenna 100, any movement (e.g., rotation or translation) of antenna 100 will result in an equivalent movement of alignment module 102. As such, any alignment determined using rigidly mounted alignment module 102 represents the alignment of antenna 100 as well. Other possible embodiments of the invention have the alignment module integrated into the base station's antenna, for example, (1) in the top or bottom of the antenna and (2) behind the antenna reflector.

Figure 2:
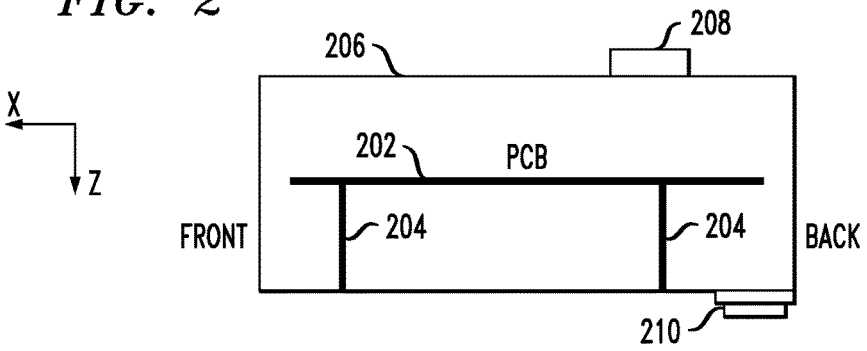
FIG. 2 shows a simplified, cross-sectional, side view of the alignment module of FIG. 1.

FIG. 2 shows a simplified, cross-sectional, side view of alignment module 102 of FIG. 1. As shown in FIG. 2, alignment module 102 has a printed circuit board (PCB) 202 mounted via stand-off structures 204 within an enclosure 206 having a global positioning system (GPS) antenna 208 and AISG (an industry standards group) connectors 210, both of which are electrically connected to PCB 202.

Figure 3:
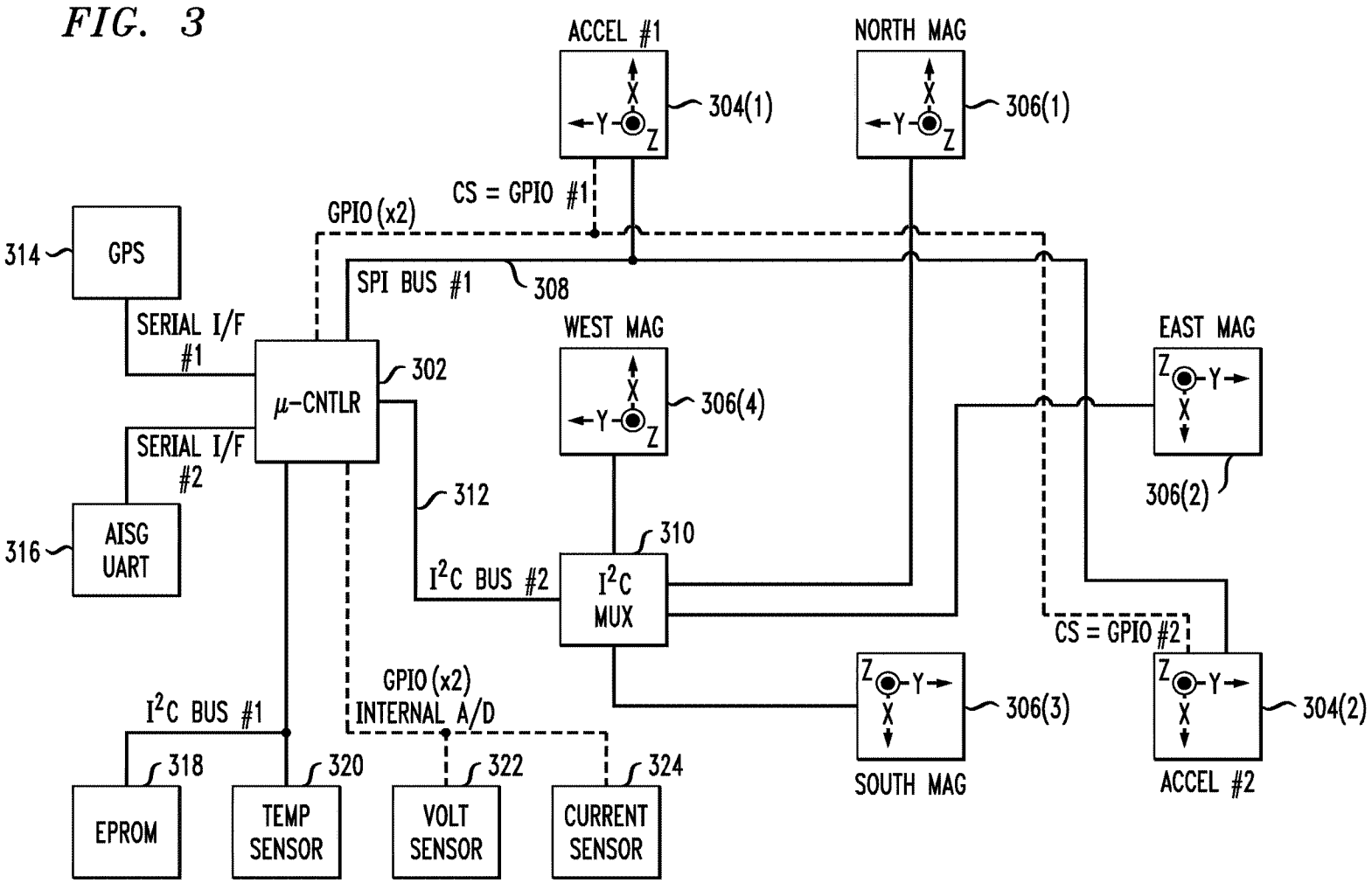
FIG. 3 shows a simplified, schematic block diagram of the printed circuit board (PCB) of FIG. 2.

FIG. 3 shows a simplified, schematic block diagram of PCB 202 of FIG. 2. At the heart of PCB 202 is (micro) controller 302, which controls the operations of alignment module 102. As shown in FIG. 3, exemplary PCB 202 has two accelerometers 304(1)-304(2) and four magnetometers 306(1)-306(4). Sensor signals generated by the three accelerometers are provided to controller 302 via SPI (serial peripheral interface) bus 308, while sensor signals from the four magnetometers are combined by multiplexer (MUX) 310 and provided to controller 302 via $I^2C$ (inter integrated circuit) bus 312. As described further below, other configurations having other numbers of accelerometers and/or other numbers of magnetometers are possible.

In addition, PCB 202 has GPS receiver 314 (which is connected to GPS antenna 208 of FIG. 2), AISG UART (universal asynchronous receiver/transmitter) 316 (which is connected to AISG connectors 210 of FIG. 2), EPROM (electronically programmable read-only memory) 318, temperature sensor 320, voltage sensor 322, and current sensor 324, all of which communicate with controller 302 via various corresponding buses or other data interfaces.

As described in more detail below, controller 302 receives signals generated by the various sensors and processes those sensor signals to determine the current alignment of antenna 100 on which alignment module 102 is rigidly mounted. Depending on the particular implementation, controller 302 communicates some or all of the results of its sensor-signal processing to the outside world via AISG UART 316.

FIGS. 4A-4C represent the relative locations and orientations of accelerometers 304 and magnetometers 306 for three different exemplary alignment modules, all of which are different from the three-accelerometer, four-magnetometer configuration of FIG. 3.

FIG. 4A shows a configuration having (i) one accelerometer 304 and (ii) one opposing pair of magnetometers 306 arranged as antipodes. As used in this disclosure, two sensors are said to be arranged as antipodes (or one sensor is said to be an antipode sensor with respect to the other sensor) when their X axes point in opposite directions, their Y axes point in opposite directions, and their Z axes point in the same direction. FIG. 4B shows a configuration having (i) two accelerometers 304 arranged as antipodes and (ii) two opposing pairs of magnetometers 306, each pair arranged as antipodes. FIG. 4C shows a configuration having (i) two opposing pairs of accelerometers 304, each arranged as antipodes, and (ii) four opposing pairs of magnetometers 306, each pair arranged as antipodes.

An alignment module, such as module 102 of FIG. 1, is designed and rigidly mounted onto a base station antenna, such as antenna 100, with the X axis of each accelerometer 304 pointing either directly towards (aka parallel) or directly away from (aka anti-parallel) the antenna's main (horizontal) pointing direction. For a vertically mounted antenna, the Z axis of each accelerometer 304 points towards the Earth's gravitational center, and the Y axis of each accelerometer 304 completes the right-hand rule, such that both the X and Y axes are in the local horizontal plane.

Similarly, the X axis of each magnetometer 306 points either towards or away from the antenna's main pointing direction or, in the exemplary configuration shown in FIG. 4C, at a 45-degree or 135-degree angle (within the horizontal plane) from the antenna's main pointing direction, with the Z axis of each magnetometer pointing towards the center of Earth such that both the magnetometer's X and Y axes are also in the horizontal plane.

In certain embodiments, when there are even numbers of accelerometers 304, the accelerometers are arranged in pairs as antipodes. Similarly, when there are even numbers of magnetometers 304, the magnetometers are arranged in pairs as antipodes. The advantage of arranging pairs of sensors as antipodes is that it simplifies the equalization of the measurements necessary to mitigate the effects of localized perturbations. Although it is possible to have embodiments with odd numbers of accelerometers and/or odd numbers of magnetometers, embodiments with even numbers are preferred.

Figure 4:
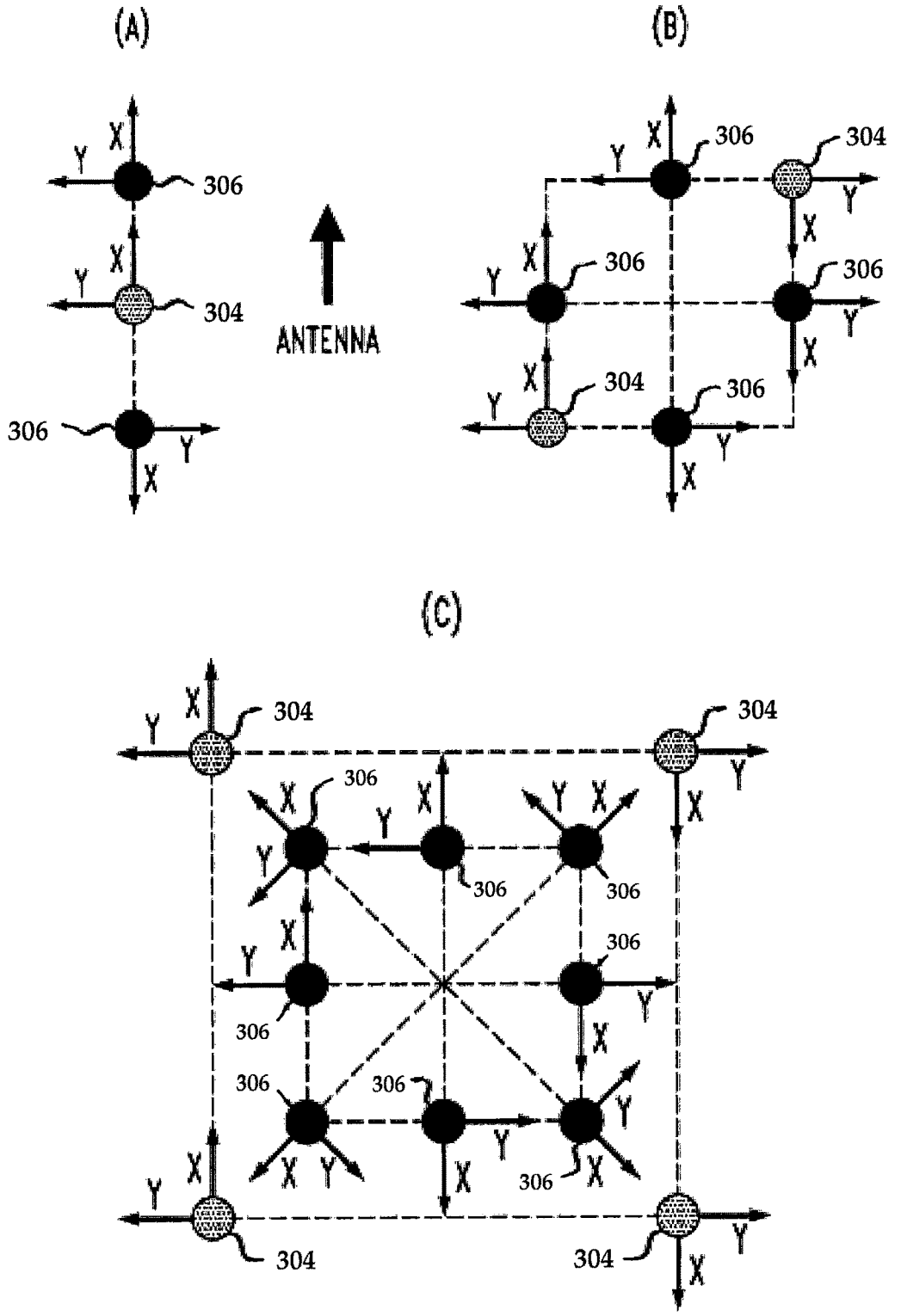
FIGS. 4A-4C represent the relative locations and orientations of accelerometers and magnetometers for three different exemplary alignment modules, all of which are different from the three-accelerometer, four-magnetometer configuration of FIG. 3.
Figure 5:
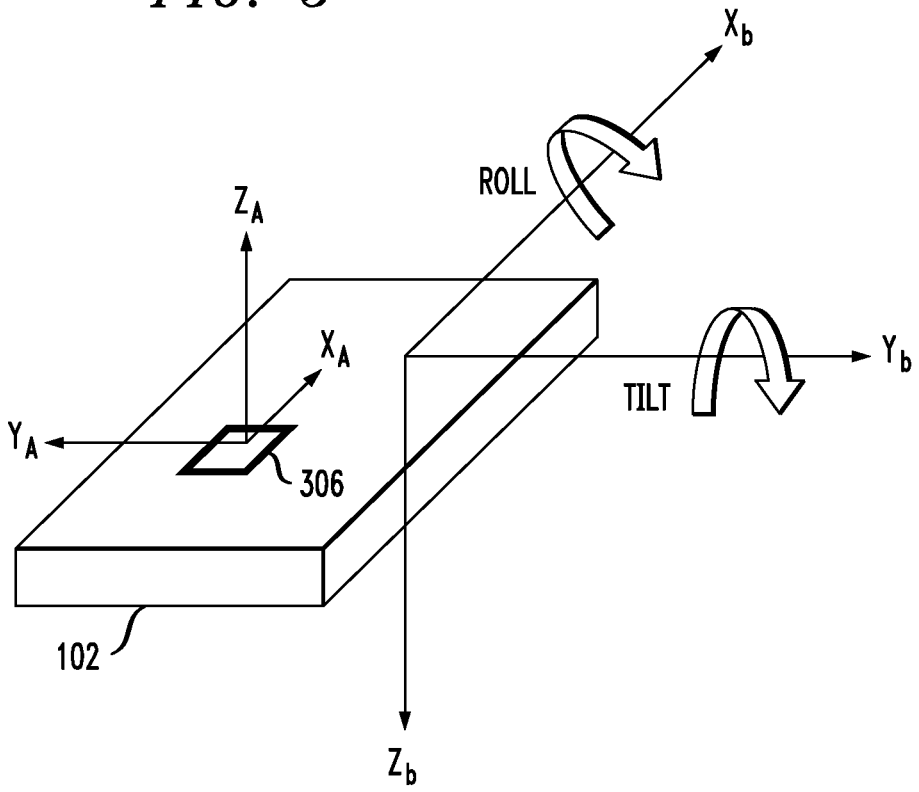
FIG. 5 defines Euler tilt and roll rotations determined using one of the accelerometers of FIGS. 3 and 4.

FIG. 5 defines Euler tilt and roll rotations determined using one of the accelerometers 304 of FIGS. 3 and 4. In FIG. 5, the accelerometer 304 is part of an alignment module, such as module 102 of FIG. 1, that is rigidly mounted onto a base station antenna (not shown), such as antenna 100 of FIG. 1, in a forward-right-down configuration in which the X-axis (labeled $X_b$) points in the direction of the antenna's main (horizontal) pointing direction, the Z-axis (labeled $Z_b$) points towards the Earth's center, and the Y-axis labeled ($Y_b$) completes the right-hand rule, such that the $X_b$ and $Y_b$ axes lie in the local horizontal plane (i.e., perpendicular to Earth's gravity). The forward-right-down configuration is also known as North/East/Down or NED, where "North" corresponds to the antenna's main point direction, not to geographic or magnetic north.

As represented in FIG. 5, a tilt rotation of alignment module 102 is a rotation about the $Y_b$ axis (when roll and yaw rotations are both zero), where the tilt angle is defined as the angle between the $X_b$ axis and the horizontal plane. Similarly, a roll rotation of alignment module 102 is a rotation about the $X_b$ axis (when tilt and yaw rotations are both zero), where the roll angle is defined as the angle between the $Y_b$ axis and the horizontal plane. Although not shown in FIG. 5, a yaw rotation is a rotation about the $Z_b$ axis (when roll and tilt rotations are both zero).

As indicated in FIG. 5, accelerometer 304 generates three output signals $X_A$, $Y_A$, and $Z_A$, which represent the three-component magnitude of the Earth's gravitational field. When accelerometer 304 is oriented with its Z axis pointing directly away from the center of Earth, then the signals $X_A$ and $Y_A$ will both be zero. For a small, pure roll rotation, the magnitude of the Earth's gravitational field will be represented by non-zero $Y_A$ and $Z_A$ components with signal $X_A$ still zero. Similarly, for a small, pure tilt rotation, the magnitude of the Earth's gravitational field will be represented by non-zero $X_A$ and $Z_A$ components with signal $Y_A$ still zero. Note that, in FIG. 5, a positive value of sensor signal $X_A$ represents a positive roll rotation, but a positive value of sensor signal $Y_A$ represents a negative tilt rotation. Note further that sensor signal $Z_A$ has its maximum positive value when both roll and tilt rotations are zero.

Thus, for an initial configuration in which (i) antenna 100 of FIG. 1 is aligned with its Z axis pointing towards the Earth's center and (ii) alignment module 102 is rigidly mounted to antenna 100 with its X axis aligned with the antenna's main (horizontal) pointing direction and its Z axis also pointing towards the Earth's center, the $X_A$ and $Y_A$ signals generated by accelerometer 304 of FIG. 5 are both zero with all of the Earth's gravitational field represented by the maximum positive $Z_A$ signal. If, over time, the orientation of antenna 100 (and therefore the orientation of the rigidly mounted alignment module 102) changes, for example, corresponding to small roll and/or tilt rotations, then the accelerometer's $Y_A$ and/or $X_A$ signals will become non-zero (either positive or negative depending on the directions of the rotations), and the $Z_A$ signal will correspondingly decrease in magnitude. In general, a change in the orientation of antenna 100 may be represented by a sequence of non-zero Euler tilt, roll, and/or yaw rotations.

The alignment modules of this disclosure have one or more accelerometers 304 and one or more magnetometers 306, whose various signals are processed to determine the current roll, tilt, and yaw angles of the base station antenna to which the alignment module is mounted. In particular, the tilt and roll angles may be determined using sensor signals from the one or more accelerometers, while the yaw angle may be determined using (i) the determined tilt and roll angles and (ii) sensor signals from the one or more magnetometers. Note that, in other applications, certain alignment modules of this disclosure may be mounted to structures other than base station antennas for use in determining the tilt, roll, and yaw angles of those other structures. When an alignment module has multiple accelerometers and/or multiple magnetometers, then multiple estimates of the tilt, roll, and/or yaw angles are calculated.

In certain exemplary embodiments, the accelerometers are oriented as North/East/Down (NED). In those embodiments, the roll ($\phi$) and tilt ($\theta$) angles can be determined from the signals $X_A$, $Y_A$, and $Z_A$ generated by accelerometer 304 as follows:

$$\phi=\arctan(Y_A/Z_A)$$

$$\theta=\arctan(-X_A/(Y_A \sin \phi+Z_A \cos \phi))$$

Note that, for accelerometers that are aligned as antipodes to accelerometer 304 of FIG. 5 within alignment module 102, the tilt and roll angles determined using these equations need to be multiplied by −1. Note further that these equations assume that a generic rotation of alignment module 102 can be represented by a particular sequence of Euler rotations consisting of a roll rotation followed by a tilt rotation. When the accelerometers have a orientation that differs from NED, the equations will be different.

By using multiple sensors, the alignment module is able to instantaneously average the multiple results, which mitigates the effect of measurement error and produces a more-accurate estimate. For an alignment module having two or more accelerometers 304, such as alignment module 102 of FIGS. 1-3, the tilt angle of the alignment module (and therefore the tilt angle of the antenna to which the alignment module is rigidly mounted) can be determined by averaging the tilt angles generated by the individual accelerometers, and similarly for the roll angle of the alignment module.

The yaw angle ($\psi$) of an alignment module is defined as the azimuth angle of the antenna, that is, a rotation about the $Z_b$ axis of FIG. 5. When tilt and roll angles are zero, the yaw angle is the angle in the local horizontal plane from the antenna's initial, main pointing direction. For a magnetometer 306 in a NED orientation (with its X axis initially pointing in the direction of the antenna's main pointing direction, its Z axis initially pointing to the center of Earth, and its Y axis completing the right-hand rule), if the tilt and roll angles of the antenna are negligible, then the yaw angle $\psi$ of the magnetometer with respect to magnetic north can be calculated from the magnetometer's signals $X_H$, $Y_H$, and $Z_H$, which represent the magnitude of the Earth's magnetic field as measured by the magnetometer along respective X, Y, and Z axes), as follows:

$$\psi=\arctan(-Y_H/X_H)$$

When the tilt and roll angles are not negligible, the calculation of the yaw angle $\psi$ can compensate for the non-zero roll $\phi$ and tilt $\theta$ angles of the antenna as follows:

$$\psi = \arctan\frac{Z_H \cdot \sin\phi - Y_H \cdot \cos\phi}{X_H \cdot \cos\theta + Y_H \cdot \sin\theta\sin\phi + Z_H \cdot \sin\theta\cos\phi},$$

where the roll $\phi$ and tilt $\theta$ angles are determined using one or more accelerometers, as described previously. This equation assumes an Euler-rotation sequence in which the yaw rotation occurs after the tilt and roll rotations.

The accuracy of using magnetometers to determine the yaw angle of an antenna is highly dependent on two important factors: (1) calculation of the magnetic declination and (2) the calculation and calibration of stray magnetic fields both within and in the vicinity of the magnetometers.

The magnetic declination is the angle within the horizontal plane between magnetic north (the direction in which the north end of a compass needle points, corresponding to the direction of the Earth's magnetic field lines) and true north (the direction along a meridian towards the geographic North Pole). This angle varies depending on one's position on the Earth's surface, and over time. In certain implementations, alignment module 102 employs algorithms from the World Magnetic Model (WMM) to calculate the declination angle based on the coordinates provided by GPS receiver 314 of FIG. 3 and adjusts the calculated azimuth by subtracting the declination angle from the calculated azimuth.

By convention, the stray magnetic fields encountered by magnetometers 306 are divided into those that exhibit a constant, additive field to the Earth's magnetic field (termed hard-iron effects) and those that influence, or distort, a magnetic field (termed soft-iron effects). To calibrate for the soft-iron effects produced by the internal electronics on the printed circuit board (e.g., PCB 202), the PCB is rotated 360 degrees in the horizontal plane (taking measurements every 30 degrees from all of the magnetometers). The procedure is then repeated in the vertical plane. By averaging the 12 measurements of a single axis from a single magnetometer obtained when rotating in a plane, a bias can be determined related to the effects the internal electronics have on those measurements. In a constant field, the above process would yield an average of zero. Biases are calculated for each axis to produce a 3D offset vector for each magnetometer. The results of this factory calibration (i.e., a factory offset vector for each magnetometer) are persistently stored in non-volatile memory (e.g., EPROM 318).

To mitigate the effect of soft-iron effects in the environment, alignment module 102 employs one or more pairs of magnetometers 306 oriented as antipodes. The alignment and orientation of each pair of magnetometers allow the measurements from the antipode sensors to be used to maintain an "average difference" between the two sensors, which can then be used to equalize the readings of both sensors (resulting in approximately equal and opposite measurements). This first step accounts for the minor variations in the manufacturing of the sensors. The last step is to average the measurements from the sensors with the same orientation. This last step reduces the impact of local distortions to the magnetic field that effect individual sensors differently. The above process is performed for each axis on each sensor and results in a three-dimensional offset ($V_X$, $V_Y$, and $V_Z$) vector (i.e., soft-iron offsets) for each sensor. Using this technique, the alignment module is able to continually adjust for transient soft-iron effects during operations.

Lastly, when hard-iron effects are present, the alignment module uses knowledge of the true azimuth angle to calibrate the magnetometers. When the true azimuth angle ψ is known, the offsets can be found iteratively by finding the values of $X'_H$, $Y'_H$, and $Z'_H$ that result in the true azimuth. The difference between $X'_H$, $Y'_H$, and $Z'_H$ and the actual readings $X_H$, $Y_H$, and $Z_H$ produces one more three-dimensional offset vector (i.e., hard-iron offsets) for each sensor to be used in the azimuth angle calculation.

The offsets described above (i.e., factory, soft-iron, and hard-iron), for each magnetometer, are combined, via vector addition, into a single offset vector and are then subtracted from the measurements from that sensor. This results in the measurements being calibrated for combined effects of the stray magnetic fields encountered by magnetometers. As a result of the calibration process, the calculation of the yaw angle ψ becomes:

$$\psi = \arctan\frac{(Z_H - V_Z)\cdot\sin\phi - (Y_H - V_Y)\cdot\cos\phi}{(X_H - V_X)\cdot\cos\theta + (Y_H - V_Y)\cdot\sin\theta\sin\phi + (Z_H - V_Z)\cdot\sin\theta\cos\phi}$$

Once calibrated, the magnetometers are able to report the correct azimuth even after the antenna's orientation changes (within +/−15 degrees). By using multiple magnetometers, as in the case of multiple accelerometers, the alignment module is able to average the multiple results in real time, which mitigates the effect of measurement error and produces a more-accurate estimate. The yaw angle for the alignment module, and therefore for the antenna, can be determined by averaging the yaw angles generated by the individual magnetometers, where each different magnetometer has its own unique set of offset values $V_X$, $V_Y$, and $V_Z$.

Using the above-described equations, the alignment module can be used to create a three-dimensional (3D) pointer with the pointing direction defined by the Euler angles: tilt, roll, and yaw. These angles can be monitored by the service provider to determine whether or not they have changed from when the antenna was initially installed. If and when a significant change in antenna orientation is detected, the service provider can decide to send a repair team to the base station to re-align the antenna. It may also be possible for the knowledge of the current orientation of the antenna to be used to adjust some of the signal processing and other operations at the base station to compensate for differences between the current orientation and the original orientation as installed.

In addition to determining and monitoring the orientation of antenna 100 using the one or more accelerometers 304 and one or more magnetometers 306 of alignment module 102, GPS receiver 314 can be used to determine and monitor the location of antenna 100. Using GPS measurements, the antenna's position can be determined with a "worst case" pseudo-range accuracy of 7.8 meters at a 95% confidence level. The actual accuracy users attain depends on factors, including atmospheric effects and receiver quality. Real-world data show that some high-quality GPS Standard Positioning Service (SPS) receivers currently provide better than three-meter horizontal accuracy. WAAS (Wide Area Augmentation System), a satellite-based augmentation system operated by the Federal Aviation Administration (FAA), supports aircraft navigation across North America. Although designed primarily for aviation users, WAAS is widely available in receivers used by other positioning, navigation, and timing communities. Using a WAAS-enabled GPS receiver, nominal accuracy is 1.6 meters. However, knowing the coordinates of the mounting structure at installation and the fact that the antenna maintains a fixed position, the antenna's position can be calculated to within a few feet (nominally) regardless of the accuracy of the GPS receiver. This information allows network operators to validate and monitor the position of each antenna after installation, which improves their ability to optimize performance and quickly isolate problems.

In certain embodiments, operations of the accelerometers 304 and/or magnetometers 306 may depend on temperature, voltage, and/or current in known ways. In such embodiments, signals from temperature sensor 320, voltage sensor 322, and/or current sensor 324 may be used by controller 302 to compensate for those dependencies.

Note that exemplary alignment module 102 of FIGS. 1-3 has two accelerometers 304, four magnetometers 306, and no gyroscopes. Other exemplary alignment modules may have (i) one or more than two accelerometers, (ii) one to three or more than four magnetometers, and/or (iii) one or more gyroscopes.

Exemplary alignment modules may have one or more of the following features:

- The data from the alignment module is available on a request/polled basis;
- The processing of the data from the alignment module is used to monitor targets and report alarms if thresholds of deviation beyond the targets are exceeded;
- The data from the alignment module is transmitted over an AISG Compliant bus;
- The data from the alignment module is communicated to an AISG controller;
- The data from the alignment module is ultimately consumed by Self Organizing Network (SON) software and used to optimize the network performance.
- The one or more magnetometers and one or more accelerometers are placed on the same hardware that is used to control Remote Electronic Tilt, which might or might not share the same processor as the magnetometers and accelerometers; and
- Two GPS receivers are used to determine azimuth, where such measurements may be used to calibrate the one or more magnetometers. The corresponding data may be reported out via the AISG connectors.

Embodiments of alignment module 102 may have one or more of the following capabilities:

- The position of antenna 100 can be determined and monitored using GPS receiver 314.
- The orientation of antenna 100 can be determined using the combination of one or more three-axis accelerometers 304 and one or more three-axis magnetometers 306.
- Tilt and roll angles can be computed on the assumption that the accelerometer readings result entirely from the alignment module orientation in the Earth's gravitational field.
- The accelerometer readings can provide tilt- and roll-angle information which can be used to correct the magnetometer data. This allows for accurate calculation of the yaw or compass heading when the alignment module is not held flat (i.e., non-zero tilt and/or roll angles).
- A 3D pointer can be implemented using the yaw (compass heading), tilt, and roll angles from the alignment module algorithms and can be monitored to determine if and when they have changed and by how much.
- The magnetometer readings can be corrected for declination angle, hard-iron effects, and soft-iron effects.

Accelerometer

When an antenna is installed, it is mounted on some type of structure with a specific position and orientation. Many times, the service provider only wants to know if the position has changed, in any way, from when it was originally installed (from this it can be assumed that the orientation has changed as well). Thus, in some antenna applications, a single accelerometer can be incorporated into the antenna as an inexpensive means to detect changes in the antenna's position. The accelerometer can determine if the antenna has been exposed to any large force and therefore can be used to notify the service provider if the antenna has experienced a jolting force. There are situations where the movement of an antenna is normal (e.g., tower sway) and others that are not (e.g., movement due to a tropical storm). The novelty of this approach is how an accelerometer can tell one from the other.

The accelerometer generates three output signals $X_A$, $Y_A$, and $Z_A$, which represent the three-component magnitude of the Earth's gravitational field. The magnitude of the typical force experienced by the accelerometer is:

$$R=\sqrt{X_A^2+Y_A^2+Z_Z^2}$$

The variations in R can be modeled with a Gaussian distribution. By calculating the sample average $\mu_R$ and variance $\sigma_R^2$ of a window of previous measurements, the following test statistic can be developed:

$$T=\frac{(R-\mu_R)}{\sigma_R}$$

The test statistic T follows a Student-T distribution and can be used to determine whether or not a "larger than normal" force is experienced. Statistically speaking, if $|T|>3.0$, then, there is a 98% probability that R is "larger than normal." The usefulness of T is that it accounts for the natural variations found in R when making a decision, which greatly reduces the number of "false alarms" from that of a typical threshold.

An accelerometer can be used to monitor an antenna to determine when "out of the ordinary" force is experienced.

Detection of Stray Magnetic Fields

As noted above, to obtain accurate azimuth readings from a magnetometer, soft-iron and hard-iron effects can be taken into account through a calibration procedure. Soft-iron effects are due to the distortion of the Earth's magnetic field by neighboring permeable materials such as iron, and hard-iron effects are due to the additional magnetic fields produced by neighboring materials that have a permanent magnetization. The calibration procedure, corrects the magnetometer readings for the soft- and hard-iron effects. If the magnetic environment changes during operation, then the magnetometer readings can become inaccurate, necessitating a re-calibration. Events that might change the magnetic environment include installation or removal of equipment in the vicinity of the magnetometer, a lightning strike which can magnetize ferrous materials in its path, etc. Therefore, it is useful to have a means for detecting when the magnetic environment changes.

The magnetic field of the Earth is generally not oriented in the local horizontal plane but at an angle to the horizontal that depends on the latitude of the observation point. To derive an azimuth angle, only the horizontal component of the Earth's magnetic field needs to be monitored. The vertical component can be used to indicate changes in the magnetic environment, since it is highly unlikely that stray magnetic fields would be oriented relative to the horizontal at exactly the same angle as the Earth's magnetic field. In particular, stray magnetic fields that are spatially non-uniform over the distance between the magnetometers would cause the magnetic field at each magnetometer to have a different angle to the horizontal, whereas the angle of the Earth's field would be the same over the relatively short distances involved.

Another way to distinguish local magnetic environment changes from antenna rotations is to compare signals from the one or more magnetometers with signals from the one or more accelerometers. An actual antenna rotation will be reflected in changes to both the magnetometer signals and accelerometer signals. If changes occur to only magnetometer signals, it can be assumed that those changes were due to magnetic environment changes.

Azimuth Determination Using GPS Satellite Signals

Signals received from the constellation of GPS satellites can be used to determine the azimuth of a base station antenna with an accuracy of about 1°. Normally, GPS antennas are non-directional within a hemisphere because they need to receive a signal from wherever a satellite is located in the sky. Using two or more antennas spaced apart in an antenna array, the desired directionality can be achieved using one of the following two methods. To avoid complicating the discussion, the case where two antennas are used is described. The distance between the GPS antennas is limited to no more than 0.2 m in order for them to fit inside the radome of a typical base station antenna.

According to the first method, two GPS antennas and receivers are used to determine the precise location of each antenna, and this information is used to calculate the azimuth. To achieve the desired accuracy of 1° with an antenna separation of only 0.2 m requires the antenna locations be determined with a precision of a few millimeters. This precision is accomplished by measuring the phase of the carrier of the GPS signal from multiple satellites (at least two) and combining these measurements with the positions of the satellites determined from the orbital information (ephemeris) transmitted by each satellite.

According to the second method, referred to as a GPS interferometer, the difference in the phase of the carrier of the GPS signal received by the two antennas is used to calculate the angle of arrival (AOA) of the signal. The position of the satellite is determined from the ephemeris transmitted by the satellite, or from the GPS almanac, which is also transmitted by the satellite, and which is also available on the web. The approximate (within a few meters) location of the antennas is determined from the GPS signals using conventional methods. The uncertainty in this location introduces an error in the azimuth which is small enough to be negligible. Knowing the position of the satellite and the position of the antennas allows the bearing to the satellite to be calculated, and combining this bearing with the AOA yields the azimuth.

Using the second method, the azimuth potentially can be derived with greater precision than using the first method, but both methods can yield an azimuth accuracy of 1° with two antennas spaced 0.2 m apart. The robustness of the techniques is enhanced by utilizing multiple satellites since, most of the time, signals can be simultaneously received from several satellites.

Embodiments of the invention may be implemented as (analog, digital, or a hybrid of both analog and digital) circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing blocks in a software program. Such software may be employed in, for example, a digital signal processor, micro-controller, general-purpose computer, or other processor.

Embodiments of the invention can be manifest in the form of methods and apparatuses for practicing those methods. Embodiments of the invention can also be manifest in the form of program code embodied in tangible media, such as magnetic recording media, optical recording media, solid state memory, floppy diskettes, CD-ROMs, hard drives, or any other non-transitory machine-readable storage medium, wherein, when the program code is loaded into and executed by a machine, such as a computer, the machine becomes an apparatus for practicing the invention. Embodiments of the invention can also be manifest in the form of program code, for example, stored in a non-transitory machine-readable storage medium including being loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits Any suitable processor-usable/readable or computer-usable/readable storage medium may be utilized. The storage medium may be (without limitation) an electronic, magnetic, optical, electromagnetic, infrared, or semiconductor system, apparatus, or device. A more-specific, non-exhaustive list of possible storage media include a magnetic tape, a portable computer diskette, a hard disk, a random access memory (RAM), a read-only memory (ROM), an erasable programmable read-only memory (EPROM) or Flash memory, a portable compact disc read-only memory (CD-ROM), an optical storage device, and a magnetic storage device. Note that the storage medium could even be paper or another suitable medium upon which the program is printed, since the program can be electronically captured via, for instance, optical scanning of the printing, then compiled, interpreted, or otherwise processed in a suitable manner including but not limited to optical character recognition, if necessary, and then stored in a processor or computer memory. In the context of this disclosure, a suitable storage medium may be any medium that can contain or store a program for use by or in connection with an instruction execution system, apparatus, or device.

The functions of the various elements shown in the figures, including any functional blocks labeled as "processors," may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those of ordinary skill in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A system for determining orientation of a base station antenna, the system comprising:

a plurality of accelerometers rigidly mounted to the base station antenna, wherein at least one pair of accelerometers are arranged as antipodes so that first axes of each accelerometer in the at least one pair of accelerometers point in opposite directions, second axes of each accelerometer in the at least one pair of accelerometers point in opposite directions, and third axes of each accelerometer in the at least one pair of accelerometers point in the same direction, wherein the first, second, and third axes are perpendicular to each other;

a plurality of magnetometers rigidly mounted to the base station antenna, wherein at least one pair of the magnetometers are arranged as antipodes so that fourth axes of each magnetometer in the at least one pair of magnetometers point in opposite directions, fifth axes of each magnetometer in the at least one pair of magnetometers point in opposite directions, and sixth axes of each magnetometer in the at least one pair of magnetometers point in the same direction, wherein the fourth, fifth, and sixth axes are perpendicular to each other; and a controller configured to (i) receive signals from the one or more accelerometers and the one or more magnetometers and (ii) determine tilt, roll, and yaw angles of the base station antenna, wherein the controller is configured to:

(1) determine the tilt and roll angles of the base station antenna based on the signals from the one or more accelerometers; and (2) determine the yaw angle of the base station antenna based on (a) the determined tilt and roll angles and (b) the signals from the one or more magnetometers.

2. The system of claim 1, wherein the controller is configured to determine the yaw angle of the base station antenna based on (a) the determined tilt and roll angles, (b) the signals from the one or more magnetometers, and (c) offset values for the one or more magnetometers.

3. The system of claim 2, wherein:

each magnetometer has a corresponding set of offset values;

the controller is configured to determine the yaw angle of each magnetometer based on (a) the determined tilt and roll angles, (b) the signals from the magnetometer, and (c) the corresponding set of offset values for the magnetometer; and the controller is configured to determine the yaw angle of the base station antenna by averaging the determined yaw angles of the plurality of magnetometers.

4. The system of claim 3, wherein the controller is further configured to compare signals from the plurality of magnetometers to determine when to re-calibrate the offset values for each magnetometer.

5. The system of claim 2, wherein the offset values are based on one or more of soft-iron effects, hard-iron effects, and factory calibration.

6. The system of claim 1, wherein:

for each accelerometer, the controller is configured to determine the tilt and roll angles of the accelerometer based on the signals from the accelerometer;

the controller is configured to determine the tilt angle of the base station antenna by averaging the determined tilt angles of the plurality of accelerometers; and the controller is configured to determine the roll angle of the base station antenna by averaging the determined roll angles of the plurality of accelerometers.

7. The system of claim 6, wherein the controller is configured to take into account one of the determined tilt angle and the determined roll angle in determining the other of the determined tilt angle and the determined roll angle.

8. A system for determining orientation of an apparatus, the system comprising:

a plurality of accelerometers rigidly mounted to the apparatus, each accelerometer having an X-axis, a Y-axis and a Z-axis, wherein at least one pair of accelerometers are arranged as antipodes on the same X-Y-Z axes;

a plurality of magnetometers rigidly mounted to the apparatus, each magnetometer having a first axis, a second axis and a third axis that are perpendicular to each other, wherein at least one pair of the magnetometers are arranged as antipodes on the same first, second, and third axes; and a controller configured to (i) receive signals from the one or more accelerometers and the one or more magnetometers and (ii) determine tilt, roll, and yaw angles of the apparatus, wherein the controller is configured to:

(1) determine the tilt and roll angles of the apparatus based on the signals from the one or more accelerometers; and (2) determine the yaw angle of the apparatus based on (a) the determined tilt and roll angles and (b) the signals from the one or more magnetometers, wherein the apparatus is a base station antenna for a wireless communications system.

9. The system of claim 1, wherein data from the alignment module is available on a request/polled basis.

10. The system of claim 1, wherein data from the alignment module is used to monitor targets and report alarms if thresholds of deviation beyond the targets are exceeded.

11. The system of claim 1, wherein data from the alignment module is transmitted over an AISG Compliant bus.

12. The system of claim 1, wherein data from the alignment module is communicated to an AISG controller.

13. The system of claim 1, wherein data from the alignment module is ultimately consumed by Self Organizing Network (SON) software and used to optimize network performance.

14. The system of claim 1, wherein the one or more magnetometers and the one or more accelerometers are placed on shared hardware that is used to control Remote Electronic Tilt.

15. The system of claim 14, wherein the shared hardware comprises a shared processor that implements the Remote Electronic Tilt and processes the signals from the one or more magnetometers and the one or more accelerometers.

16. The system of claim 1, further comprising at least two GPS antennas and receivers used to determine azimuth.

17. The system of claim 16, wherein the azimuth determined by the GPS receivers is used to calibrate the one or more magnetometers.

18. The system of claim 1, wherein:

the controller is configured to determine the yaw angle of the base station antenna based on (a) the determined tilt and roll angles, (b) the signals from the one or more magnetometers, and (c) offset values for the one or more magnetometers;

the controller comprises a plurality of magnetometers rigidly mounted to the base station antenna, wherein:

each magnetometer has a corresponding set of offset values;

the controller is configured to determine the yaw angle of each magnetometer based on (a) the determined tilt and roll angles, (b) the signals from the magnetometer, and (c) the corresponding set of offset values for the magnetometer; and the controller is configured to determine the yaw angle of the base station antenna by averaging the determined yaw angles of the plurality of magnetometers;

the controller is further configured to compare signals from the plurality of magnetometers to determine when to re-calibrate the offset values for each magnetometer;

at least one pair of the magnetometers are arranged as antipodes;

the offset values are based on one or more of soft-iron effects, hard-iron effects, and factory calibration;

the system comprises a plurality of accelerometers rigidly mounted to the base station antenna, wherein:

for each accelerometer, the controller is configured to determine the tilt and roll angles of the accelerometer based on the signals from the accelerometer;

the controller is configured to determine the tilt angle of the base station antenna by averaging the determined tilt angles of the plurality of accelerometers; and the controller is configured to determine the roll angle of the base station antenna by averaging the determined roll angles of the plurality of accelerometers;

the controller is configured to take into account one of the determined tilt angle and the determined roll angle in determining the other of the determined tilt angle and the determined roll angle; and at least one pair of the accelerometers are arranged as antipodes.

19. An alignment module for a base station antenna, the alignment module comprising:

a plurality of accelerometers rigidly mounted to the base station antenna, wherein at least one pair of accelerometers are arranged as antipodes;

a plurality of magnetometers rigidly mounted to the base station antenna, wherein at least one pair of magnetometers are arranged as antipodes;

at least one GPS antenna and GPS receiver; and a controller configured to (i) receive signals from the plurality of accelerometers, the plurality of magnetometers, and the at least one GPS antenna and GPS receiver; (ii) determine the tilt and roll angles of the base station antenna based on the signals received from the plurality of accelerometers; (iii) determine the yaw angle of the base station antenna based on (a) the determined tilt and roll angles, (b) the signals received from the plurality of magnetometers, (c) offset values for the plurality of magnetometers, and (d) a declination angle based on coordinates received from the at least one GPS antenna and GPS receiver; and (iv) determine a current alignment of the base station antenna based on the determined tilt, roll, and yaw angles.

* * * * *